US011832052B2

(12) United States Patent
Hacihabiboglu

(10) Patent No.: US 11,832,052 B2
(45) Date of Patent: Nov. 28, 2023

(54) SPHERICALLY STEERABLE VECTOR DIFFERENTIAL MICROPHONE ARRAYS

(71) Applicant: ORTA DOGU TEKNIK UNIVERSITESI, Ankara (TR)

(72) Inventor: Huseyin Hacihabiboglu, Ankara (TR)

(73) Assignee: ORTA DOGU TEKNIK UNIVERSITESI, Ankara (TR)

( * ) Notice: Subject to any disclaimer, the term of this patent is extended or adjusted under 35 U.S.C. 154(b) by 170 days.

(21) Appl. No.: 17/638,211

(22) PCT Filed: Aug. 28, 2020

(86) PCT No.: PCT/TR2020/050784
§ 371 (c)(1),
(2) Date: Feb. 25, 2022

(87) PCT Pub. No.: WO2021/040667
PCT Pub. Date: Mar. 4, 2021

(65) Prior Publication Data

US 2022/0337944 A1 Oct. 20, 2022

(30) Foreign Application Priority Data

Aug. 28, 2019 (TR) ..... 2019/13009

(51) Int. Cl.
*H04R 3/00* (2006.01)
*H04R 1/40* (2006.01)

(52) U.S. Cl.
CPC ..... *H04R 1/406* (2013.01); *H04R 3/005* (2013.01); *H04R 2201/401* (2013.01)

(58) Field of Classification Search
CPC ... H04R 1/406; H04R 3/005; H04R 2201/401
USPC ..... 381/92, 122
See application file for complete search history.

(56) References Cited

U.S. PATENT DOCUMENTS

| | | | | |
|---|---|---|---|---|
| 4,042,779 | A | 8/1977 | Craven et al. | |
| 2010/0008517 | A1 | 1/2010 | Elko et al. | |
| 2012/0093337 | A1* | 4/2012 | De Sena | H04R 3/005 381/92 |

(Continued)

OTHER PUBLICATIONS

Boaz Rafaely, Bessel Nulls Recovery in Spherical Microphone Arrays for Time-Limited Signals, IEEE Transactions on Audio, Speech, and Language Processing, 2011, pp. 2430-2438, vol. 19, No. 8.

(Continued)

*Primary Examiner* — Ammar T Hamid
(74) *Attorney, Agent, or Firm* — Bayramoglu Law Offices LLC

(57) ABSTRACT

A spherically steerable microphone array structure is provided. The spherically steerable microphone array structure uses pressure and acoustic particle velocity signals obtained from sensors positioned co-planarly on a circular arc. The spherically steerable microphone array structure allows a calculation of all spatial partial derivatives of a sound field up to a given order. The spatial partial derivatives are used to obtain a spherical harmonic decomposition of a recorded sound field. Spherical harmonic decomposition coefficients are used in a spherically direction-invariant acoustic mode beamforming.

6 Claims, 6 Drawing Sheets

(56) References Cited

U.S. PATENT DOCUMENTS

2015/0055796 A1 2/2015 Nugent et al.

OTHER PUBLICATIONS

Guangzheng Yu, et al., Analysis on multiple scattering between the rigid-spherical microphone array and nearby surface in sound field recording, Audio Engineering Society 133rd Convention Paper 8710, 2012, pp. 1-6.
Gary W. Elko, Differential Microphone Arrays, Audio Signal Processing, pp. 11-65.
Enzo De Sena, et al., On the Design and Implementation of Higher Order Differential Microphones, IEEE Transactions on Audio, Speech, and Language Processing, 2012, pp. 162-174, vol. 20, No. 1.
Hui Song, et al., First-Order Differential Microphone Array for Robust Speech Enhancement, ICALIP, 2008, pp. 1461-1466, IEEE.
Enzo De Sena, et al., Analysis and Design of Multichannel Systems for Perceptual Sound Field Reconstruction, IEEE Transactions on Audio, Speech, and Language Processing, 2013, pp. 1653-1665, vol. 21, No. 8.
Jacob Benesty, et al., Design of Circular Differential Microphone Arrays, Springer Topics in Signal Processing, 2015, pp. 1-166, vol. 12.
Gongping Huang, et al., Design of Planar Differential Microphone Arrays With Fractional Orders, IEEE/ACM Transactions on Audio, Speech, and Language Processing, 2020, pp. 116-130, vol. 28.
Jens Meyer, et al., A Highly Scalable Spherical Microphone Array Based on an Orthonormal Decomposition of the Soundfield, 2002, pp. II-1781-II-1784, vol. 2, IEEE.
Boaz Rafaely, Fundamentals of Spherical Array Processing, Springer Topics in Signal Processing, 2015, pp. 1-193, vol. 8.
Sébastien Moreau, et al., 3D Sound Field Recording with Higher Order Ambisonics—Objective Measurements and Validation of a 4th Order Spherical Microphone, Audio Engineering Society 120th Convention Paper, 2006, pp. 1-24.
Ege Erdem, et al., Perceptual Soundfield Reconstruction in Three Dimensions via Sound Field Extrapolation, ICASSP, 2019, pp. 8023-8027, IEEE.
Mert Burkay Coteli, et al., Multiple Sound Source Localization With Steered Response Power Density and Hierarchical Grid Refinement, IEEE/ACM Transactions on Audio, Speech, and Language Processing, 2018, pp. 2215-2229, vol. 26, No. 11.
Sakari Tervo, et al., Direction of Arrival Estimation of Reflections from Room Impulse Responses Using a Spherical Microphone Array, IEEE/ACM Transactions on Audio, Speech, and Language Processing, 2015, pp. 1539-1551, vol. 23, No. 10.
Abdullah Fahim, et al., PSD Estimation and Source Separation in a Noisy Reverberant Environment Using a Spherical Microphone Array, IEEE/ACM Transactions on Audio, Speech, and Language Processing, 2018, pp. 1594-1607, vol. 26, No. 9.
Mert Burkay Coteli, et al., Acoustic Source Separation Using Rigid Spherical Microphone Arrays Via Spatially Weighted Orthogonal Matching Pursuit, International Workshop on Acoustic Signal Enhancement (IWAENC2018), 2018, pp. 81-85, IEEE.
Finn Jacobsen, et al., The Microflown Particle Velocity Sensor, pp. 1283-1291.
Todd A. Ell, et al., Quaternion Fourier Transforms for Signal and Image Processing, 2014, pp. 1-127, ISTE Ltd and John Wiley & Sons, Inc.
Haohai Sun, et al., Space Domain Optimal Beamforming for Spherical Microphone Arrays, ICASSP, 2010, pp. 117-120, IEEE.
Daniel P. Jarrett, et al., Theory and Applications of Spherical Microphone Array Processing, Springer Topics in Signal Processing, 2017, pp. 1-187, vol. 9.
Mert Burkay Coteli, et al., Multiple Sound Source Localization with Rigid Spherical Microphone Arrays via Residual Energy Test, ICASSP, 2019, pp. 790-794, IEEE.

* cited by examiner

SPHERICALLY STEERABLE VECTOR DIFFERENTIAL MICROPHONE ARRAYS

CROSS REFERENCE TO THE RELATED APPLICATIONS

This application is the national stage entry of International Application No. PCT/TR2020/050784, filed on Aug. 28, 2020, which is based upon and claims priority to Turkish Patent Application No. 2019/13009 filed on Aug. 28, 2019, the entire contents of which are incorporated herein by reference.

TECHNICAL FIELD

The present invention relates to a co-planar array of acoustic sensors and the associated processing stages which can be used to synthesize a desired directional response that can be steered in any direction on the unit sphere directionally-invariantly.

BACKGROUND

In the prior art, spherically steerable microphone arrays are either i) low-order as in the case of B-format microphones [1], or ii) have singularities in their frequency responses making it impossible to obtain a steered beam at certain frequencies as in open spherical microphone arrays [2], or iii) incorporate a scatterer to mitigate the said singularities as a result of which the microphone array interacts with the sound field being recorded as in rigid spherical microphone arrays [3].

A class of microphone arrays called differential microphone arrays (DMA) can be used to obtain any desired directivity pattern up to given order [4]. DMAs comprise multiple omnidirectional microphones whose signals are delayed and combined to obtain a fixed directivity pattern that satisfies certain constraints such as having a maximum front-back ratio or having maximum directivity [5]. While DMAs are useful in a variety of applications from speech enhancement [6] to spatial audio recording [7], some of their inherent properties limit their use in a wider domain. These are the axial or circular symmetry which limit their use in spherically isotropic sound fields, and noise amplification, specifically at low frequencies [4]. These limitations constrained DMA designs mainly to linear [5], circular [8] and planar [9] configurations. When a linear configuration is used, the resulting beam can be steered only in two directions. For a circular or planar configuration, the beam can be circularly steered. Microphone arrays that can be used in three-dimensional steered beamforming typically require a 3D constellation of microphones. Rigid spherical microphone arrays (RSMAs) that can provide an order-limited spherical harmonic decomposition of the sound field, comprise a number of microphones positioned on a rigid spherical baffle [10, 11]. RSMAs have a well-developed theory and have been used in a variety of tasks including spatial audio recording [12, 13], direction-of-arrival (DOA) estimation [14, 15], and source separation [16,17]. Development of anemometric MEMS particle velocity sensors [18] made it possible to design systems that can provide a measurement of the true acoustic particle velocity. Such sensors can also overcome low-frequency noise amplification issue that is observed in differential measurements of particle velocity that use multiple pressure sensors. Another important advantage of anemometric particle velocity sensors is that they are miniaturized, allowing smaller form-factor instrument designs.

An ideal spherically steerable microphone array should satisfy the following requirements:

a. Directivity pattern of the steered beam obtained using the said array should be spherically direction-invariant.
b. Directivity pattern of the steered beam obtained using the said array should be substantially the same for a wide range of frequencies.
c. The array should have a small form factor to minimize its interaction with the sound field being recorded.

SUMMARY

The present invention is related to a Spherically Steerable Vector Differential Microphone Array that meets the requirements mentioned above, eliminates the outlined disadvantages and brings about some new advantages.

The invention comprises a circular arrangement of pressure and acoustic particle velocity sensors combination of which provides a beam whose shape can be arbitrarily selected and is spherically steerable in three dimensions. The design allows extracting up to the third-order spherical harmonic decomposition of the sound field which can then be used to obtain a spherically direction-invariant steered beam.

BRIEF DESCRIPTION OF THE DRAWINGS

The figures used to better explain Spherically Steerable Vector Differential Microphone Arrays developed with this invention and their descriptions are as follows.

DETAILED DESCRIPTION OF THE EMBODIMENTS

Figure 1B:
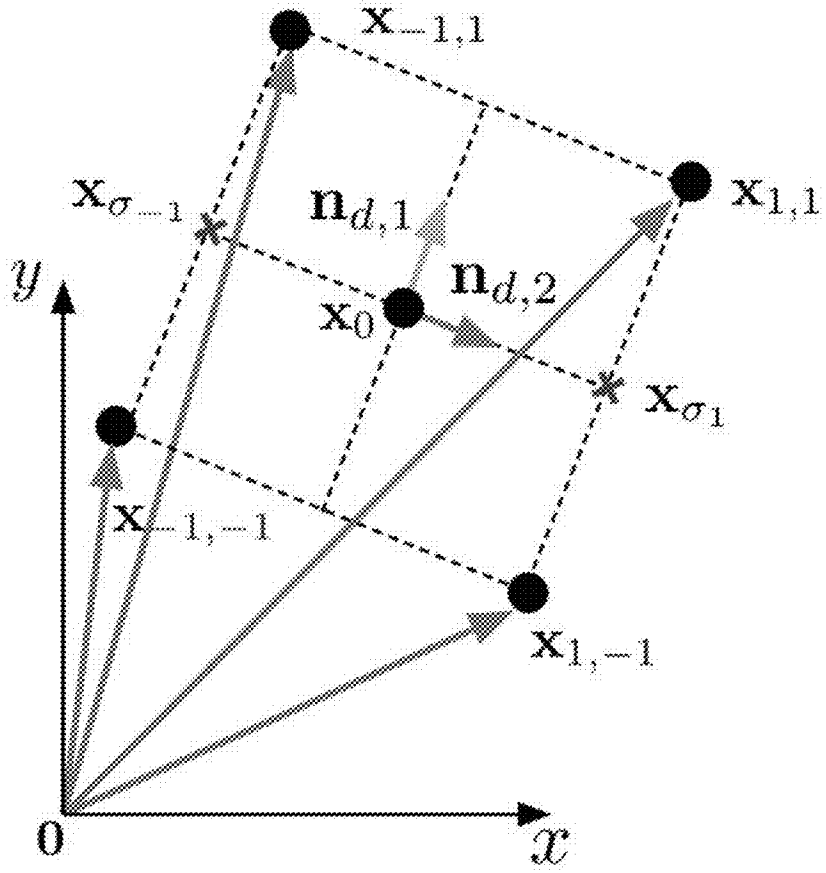
FIG. 1B Geometry used for calculating mixed-order partial directional derivatives.

To better explain Spherically Steerable Vector Differential Microphone Arrays developed with this invention, the details are as presented below.

Modal Beamforming in the Spherical Harmonic Domain

Acoustic beamforming refers to the spatial filtering of a sound field using signals from multiple microphones, for example to increase the relative level of a signal in the presence of interferers. For a diffuse sound field, p(t), beamforming aims to obtain:

$$p_b(t)=\Gamma(\theta,\phi)p(t) \tag{1}$$

where $0\leq\phi<2\pi$ and $0\leq\theta\leq\pi$ are the azimuth and inclination angles, and $\Gamma(\theta,\phi)$ is a beam pattern which can be specified according to different, application specific criteria.

The beamforming approach used in the proposed array comprises two stages (1) calculation of the spherical harmonic decomposition of the sound field (eigenbeamforming), and (2) modal beamforming which linearly combines the calculated eigenbeams to obtain a desired beam pattern in a given direction.

Eigenbeams are orthonormal beam patterns that can be used for synthesizing other beam patterns using their linear combinations. They can be compactly represented using spherical harmonic functions given as:

$$Y_n^m(\theta,\phi)=\sqrt{\frac{(2n+1)}{4\pi}\frac{(n-m)!}{(n+m)!}}P_n^m(\cos\theta)e^{-Im\phi} \tag{2}$$

where n and m are the degree and order of the spherical harmonic function, and $P_n(\cdot)$ is the associated Legendre polynomial, respectively. Notice that we are using the symbol $I=\sqrt{-1}$ to denote the imaginary unit instead of the usual i or j in order to avoid confusion with the quaternion basis elements that are used in the following exposition.

Direction dependent part of $Y_n^m(\theta,\phi)$ is the product of an associated Legendre polynomial and a complex exponential. Let us define this direction-dependent part as $\gamma_n^m(\theta,\phi)=P_n^m(\cos\theta)e^{-Im\phi}$. We will now show that $\gamma_n^m(\theta,\phi)$ can be represented as a linear combination of trigonometric monomials.

Associated Legendre polynomials can be expressed in closed form as:

$$P_n^m(\cos\theta)=\sum_{k=m}^{n}\binom{n}{k}\binom{\frac{n+k-1}{2}}{n}\frac{(-1)^m2^nk!}{(k-m)!}\sin^m\theta\cos^{k-m}\theta \tag{3}$$

which is a polynomial comprising trigonometric monomials of the form $\sin^m\theta\cos^{k-m}\theta$.

Complex exponential term, $e^{im\phi}=\cos m\phi+I\sin m\phi$ can also be expressed as a linear combination of trigonometric monomial terms such that:

$$\cos m\phi=\sum_{k=0}^{\lfloor m/2\rfloor}(-1)^k\binom{m}{2k}\sin^{2k}\phi\cos^{m-2k}\phi \tag{4}$$

$$\sin m\phi=\sum_{k=0}^{\lfloor (m-1)/2\rfloor}(-1)^k\binom{m}{2k+1}\sin^{2k+1}\phi\cos^{m-2k-1}\phi \tag{5}$$

In other words, a spherical harmonic function can be represented as a trigonometric polynomial with monomial terms of the form $T_{n,|m|}^{(l)}(\theta,\phi)=(\sin\theta\cos\phi)^{|m|-l}(\sin\theta\sin\phi)^l\cos^{n-|m|}\theta$ with $n\geq|m|\geq l\geq 0$, such that:

$$Y_n^m(\theta,\phi)=\Sigma_{n,m,l}(a_{n,m}^{(l)}+Ib_{n,m}^{(l)})T_{n,m}^{(l)}(\theta,\phi) \tag{6}$$

An arbitrary beam pattern $\Gamma(\theta,\phi)$ can be represented as a linear combination of eigenbeams, a process also known as weight-and-sum beamforming such that:

$$\Gamma(\theta,\phi)=\Sigma_{n=0}^{\infty}\Sigma_{m=-n}^{n}w_{n,m}Y_n^m(\theta,\phi) \tag{7}$$

where $w_{nm}\in C$ are modal beamforming coefficients. Selecting $w_{n,m}=(-1)^m w_{n,-m}$ results in a real-valued, axisymmetric directivity pattern which is of particular interest in many different use cases.

In practical applications (7) is limited to a maximum order of N, typically dictated by the number of elements in a microphone array. Beamformer output given in (1) can then be represented as a combination of multiple eigenbeamformer outputs such as:

$$p_b(t)=\Sigma_{n=0}^{N}\Sigma_{m=-n}^{n}a_{n,m}p(t)Y_n^m(\theta,\phi) \tag{8}$$

In other words, in order to obtain a desired beam shape in a given direction terms in the form $p(t)T_{n,|m|}^{(l)}(\theta,\phi)$ need to be obtained. Such terms can be obtained via spatial derivatives of the particle velocity field.

Spatial Derivatives of Particle Velocity Signals

The analysis of VDMAs is simpler in the quaternion Fourier domain. The following exposition uses the quaternion algebra and quaternion signal processing formalism [19].

A. Particle Velocity as a Pure Quaternion Signal

We define particle velocity as a pure quaternion valued time domain signal such that $u(x,t)\in V(\mathbb{H})$ where $u(x,t)=u_x(x,t)i+u_j(x,t)j+u_z(x,t)k$ where i, j and k are the fundamental quaternion units such that $i^2=j^2=k^2=ijk=-1$.

Particle velocity and pressure fields are related via the preservation of momentum such that:

$$\rho_0\frac{\partial u(x,t)}{\partial t}=-\nabla p(x,t). \tag{9}$$

Defining the unit pure quaternion $v\in V(\mathbb{H})$ as an arbitrary transform axis, (9) can be represented in the left-sided quaternion frequency domain as:

$$\rho_0 v\omega U^v(x,\omega)=-P_\nabla^v(x,\omega) \tag{10}$$

Let us now express the relation between the pressure and particle velocity components of a monochromatic plane wave at an arbitrary point x as:

$$u(x,t)=(\rho_0c)^{-1}\mu p(x,t) \tag{11}$$

where $\mu\in V(\mathbb{H})$ is a pure unit quaternion coincident with the propagation direction of the wave. Without loss of generality, we will assume that measurements of particle velocity, normalized with respect to pressure are available, allowing us to omit the constant scaling term such that $u(x,t)=p(x,t)\mu$.

Particle velocity at point x can be expressed in terms of the particle velocity at the origin such that:

$$U^{\nu}(x,\omega)=e^{\nu\langle k,x\rangle}U_0^{\nu}(\omega) \tag{12}$$

where $$k=\frac{\omega}{c}\overline{\mu}=\frac{\omega}{c}\left[\mathfrak{I}_i(\mu)\mathfrak{I}_j(\mu)\mathfrak{I}_k(\mu)\right]$$

is the wave vector and $\langle\cdot,\cdot\rangle$ represents the inner product of two vectors. Notice that we used $\overline{\mu}=[\cos\phi\sin\theta\sin\phi\sin\theta\cos\theta]\in\mathbb{R}$ to represent the unit vector denoting the propagation direction of the wave, slightly abusing quaternion algebraic notation in favor of expositional clarity.

B. First-Order Spatial Derivatives

Figure 1A:
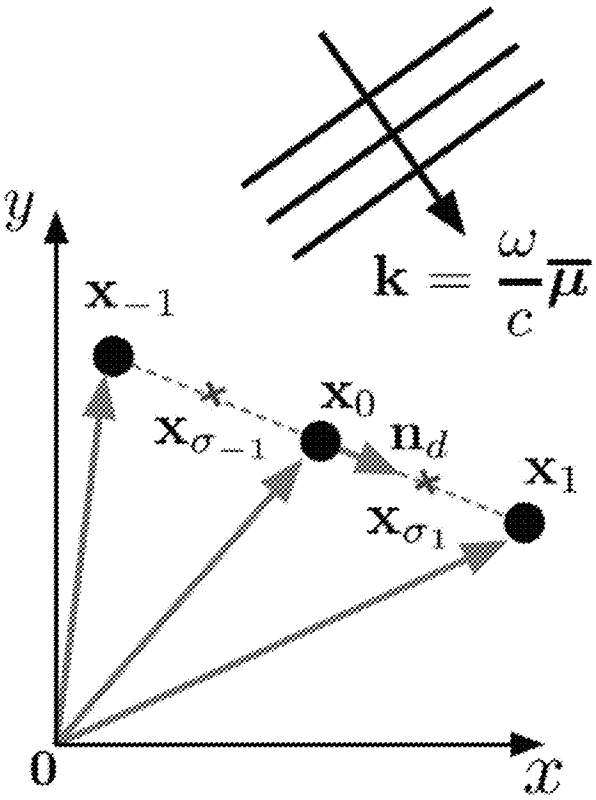
FIG. 1A Geometry used for calculating first- and pure second-order partial directional derivatives.

Let us consider the general case for which pure quaternion-valued particle velocity signals are measured at two different positions $x_{-1}$ and $x_1$ (see FIG. 1A). The derivative of the particle velocity signals in the direction $n_d=x_\Delta/\|x_\Delta\|=(x_1-x_{-1})/\|x_1-x_{-1}\|$ can be approximated at the median of these two points, $x_0=(x_1+x_{-1})/2$, such that:

$$\left.\frac{\partial u(x,t)}{\partial n_d}\right|_{x=x_0}\approx\Delta u(x_0,t\mid x_1,x_{-1})=\|x_\Delta\|^{-1}[u(x_1,t)-u(x_{-1},t)], \tag{13}$$

where $u(x_1,t)$ and $u(x_2,t)$ are the pure quaternion-valued acoustic particle velocity signals measured at $x_1$ and $x_{-1}$, respectively. Transforming the expression using a left-sided QFT to the frequency-domain, we obtain:

$$\begin{aligned}\left.\frac{\partial U^{\nu}(x,\omega)}{\partial n_d}\right|_{x=x_0}&\approx\Delta U^{\nu}(x,\omega\mid x_1,x_{-1})\\&=\|x_\Delta\|^{-1}[U^{\nu}(x_1,\omega)-U^{\nu}(x_{-1},\omega)]\\&=2\|x_\Delta\|^{-1}\nu e^{\nu\langle k,x_\sigma\rangle}\sin\langle k,x_\Delta\rangle U_0^{\nu}(\omega).\end{aligned} \tag{14}$$

For low frequencies or when the distance between the measurement points is small such that $$\frac{\omega}{c}\|x_\Delta\|\ll\frac{\pi}{2},$$

the finite difference approximation above can be simplified, such that:

$$\Delta U^{\nu}(x_0,\omega\mid x_1,x_{-1})\approx 2c^{-1}\,\nu\omega e^{\nu\langle k,x_\sigma\rangle}\langle\overline{\mu},n_d\rangle\,U_0^{\nu}(\omega) \tag{15}$$

Notice that spatial differentiation imposes the directional weight, $\langle\overline{\mu},n_d\rangle$ which is a trigonometric trinomial in the general case and degenerates into trigonometric monomials with an appropriate selection of the reference axis, $n_d$.

Representing (15) in the time domain using a left-sided inverse QFT we obtain:

$$\Delta u(x_0,t\mid x_1,x_{-1})\approx 2c^{-1}\langle\overline{\mu},n_d\rangle\frac{\partial u(x_0,t+\langle k,x_\sigma\rangle)}{\partial t} \tag{16}$$

Integration in time of the directional derivative of the acoustic particle velocity results in:

$$\begin{aligned}u_{\Delta,}(x_0,t)&=\int_{-\infty}^{t}\Delta u(x_0,\tau\mid x_1,x_{-1})d\tau\\&\approx 2c^{-1}\mu\langle\overline{\mu},n_d\rangle p(x_0,t+\langle k,x_\sigma\rangle)\end{aligned} \tag{17}$$

Multiplying from the left-hand side with a pure unit quaternion $\eta$ in a desired direction and obtaining the scalar part results in:

$$S[u_\Delta,(x_0,t)v]=-2c^{-1}\langle\overline{\mu},\overline{\eta}\rangle\langle\overline{\mu},n_d\rangle p(x_0,t+\langle k,x_\sigma\rangle) \tag{18}$$

which includes two directional weight terms that can be specified to obtain the desired second-order directional weight terms. If the measurement points are selected to be symmetric with respect to the origin such that $x=x_1=-x_2$, then $x_0=0$ and the time delay in (18) disappears. Selecting the measurement points such that $n_d$ is coincident with the x or the y axes and also selecting $\overline{\eta}$ to be coincident with either one of these principal axes all second-degree terms can be obtained. For example, selecting $n_d=[1,0,0]$ (i.e. sensors are aligned with the x-axis) and $\eta=j$ (i.e. $\overline{\eta}=[0,1,0]$) yields the second-degree trigonometric monomial, $T_{2,2}^{(1)}(\theta,\phi)=\sin^2\theta\cos\phi\sin\phi$ as a directional weight.

C. Second-Order Derivatives

The process used to obtain second-order terms can be extended to third and higher-order trigonometric monomials by an appropriate selection of measurement points. Only the method to obtain the third-degree terms is shown here for conciseness.

1) Pure Second-Order Derivatives:

Let us select three collinear measurement points $x_{-1}$, $x_0$, and $x_1$ such that $x_1-x_0=x_0-x_{-1}$, and define two median points $x_{\sigma,-1}=(x_0+x_{-1})/2$ and $x_{\sigma,1}=(x_0+x_1)/2$ (see FIG. 1A). The finite difference approximation to the second-order directional derivative is given in the frequency-domain as:

$$\begin{aligned}\Delta^2U^{\nu}(x_0,\omega\mid x_{\sigma_1},x_{\sigma_2})&=\frac{\Delta U^{\nu}(x_{\sigma_1},\omega)-\Delta U^{\nu}(x_{\sigma-1},\omega)}{\|x_{\sigma_1}-x_{\sigma_{-1}}\|}\\&\approx 4c^{-2}\omega^2e^{\nu\langle k,x_0\rangle}\langle\overline{\mu},n_d\rangle^2U_0(\omega).\end{aligned} \tag{19}$$

Representing (19) in the time domain, we obtain:

$$\Delta^2u(x_0,t\mid x_{\sigma_1},x_{\sigma_2})\approx 4c^{-2}\langle\overline{\mu},n_d\rangle^2\frac{\partial^2u(x_0,t+\langle k,x_0\rangle)}{\partial t^2} \tag{20}$$

This expression needs to be integrated twice in time to obtain a third-degree directional term:

$$\begin{aligned}u_{\Delta^2,}(x_\sigma,t)&=\int_{-\infty}^{t}\int_{-\infty}^{t}\Delta^2u(x_\sigma,\tau\mid x_{\sigma_1},x_{\sigma_2})d\tau dk\\&\approx 4c^{-2}\mu\langle\overline{\mu},n_d\rangle^2p(x_0,t-\langle k,x_0\rangle)\end{aligned} \tag{21}$$

which can be left-multiplied by a pure unit quaternion $\eta$ in a desired direction to obtain a directionally weighted, quaternion-valued signal whose scalar part contains a third-degree trigonometric monomial as a directional term, such that:

$$S[u_{\Delta^2}, (x_0, t)\eta] = -4c^{-2}\langle\overline{\mu}, \overline{\eta}\rangle\langle\overline{\mu}, n_d\rangle^2 p(x_0, t - \langle k, x_0\rangle) \tag{22}$$

As with the first-order derivatives, all third-degree trigonometric monomials can be obtained this way. For example, selecting $n_d=[0,1,0]$ and $\eta=k$ (i.e. $\overline{\eta}=[0,0,1]$) yields the third-degree trigonometric monomial $T_{3,2}^{(2)}(\theta,\phi)=\sin^2\theta\cos\theta\sin^2\phi$ as a directional weight.

2) Mixed Second-Order Derivatives:

Let us select four particle velocity measurement points, $x_{1,1}$, $x_{-1,1}$, $x_{-1,-1}$, and $x_{1,-1}$ on the vertices of a square with a side length of d (see FIG. 1B) and define their mid-point as $x_0=\frac{1}{4}\Sigma_{q,r\in-1,1}x_{q,r}$. Let us also define two orthogonal axes $n_{d,1}=(x_{1,1}-x_{1,-1})/d$ and $n_{d,2}=(x_{1,1}-x_{-1,1})/d$ be calculated using different partial derivatives. More specifically $$u_{\Delta^2,}(x_0,t)=\int_{-\infty}^{t}\int_{-\infty}^{t}\Delta^2 u(x_0,\tau|x_{94\ 1},x_{\sigma 2})d\tau d\kappa \tag{23}$$

where $$\Delta^2 u(x_0,\tau|x_{\sigma 1},x_{\sigma 2})=d^{-1}[\Delta u(x_{\sigma 1},t|x_{1,1},x_{1,-1})-\Delta u(x_{\sigma 2}, t|x_{-1,1},x_{-1,-1})] \tag{24}$$

The second-order mixed partial derivatives in the two orthogonal directions $n_{d,1}$ and $n_{d,2}$ can then be used to obtain third-order terms such that:

$$S[u_{\Delta^2}, (x_0, t)\eta] = -4c^{-2}\langle\overline{\mu}, n_{d,1}\rangle\langle\overline{\mu}, n_{d,2}\rangle\langle\overline{\mu}, \overline{\eta}\rangle p(x_0, t - \langle k, x_0\rangle) \tag{25}$$

Selecting $n_{d,1}=[1,0,0]$, $n_{d,2}=[0,1,0]$ and $\eta=k$ yields the third-degree directional term $\sin^2\theta\cos\theta\sin\phi\cos\phi$.

IV. Vector Differential Microphone Arrays

Figure 2:
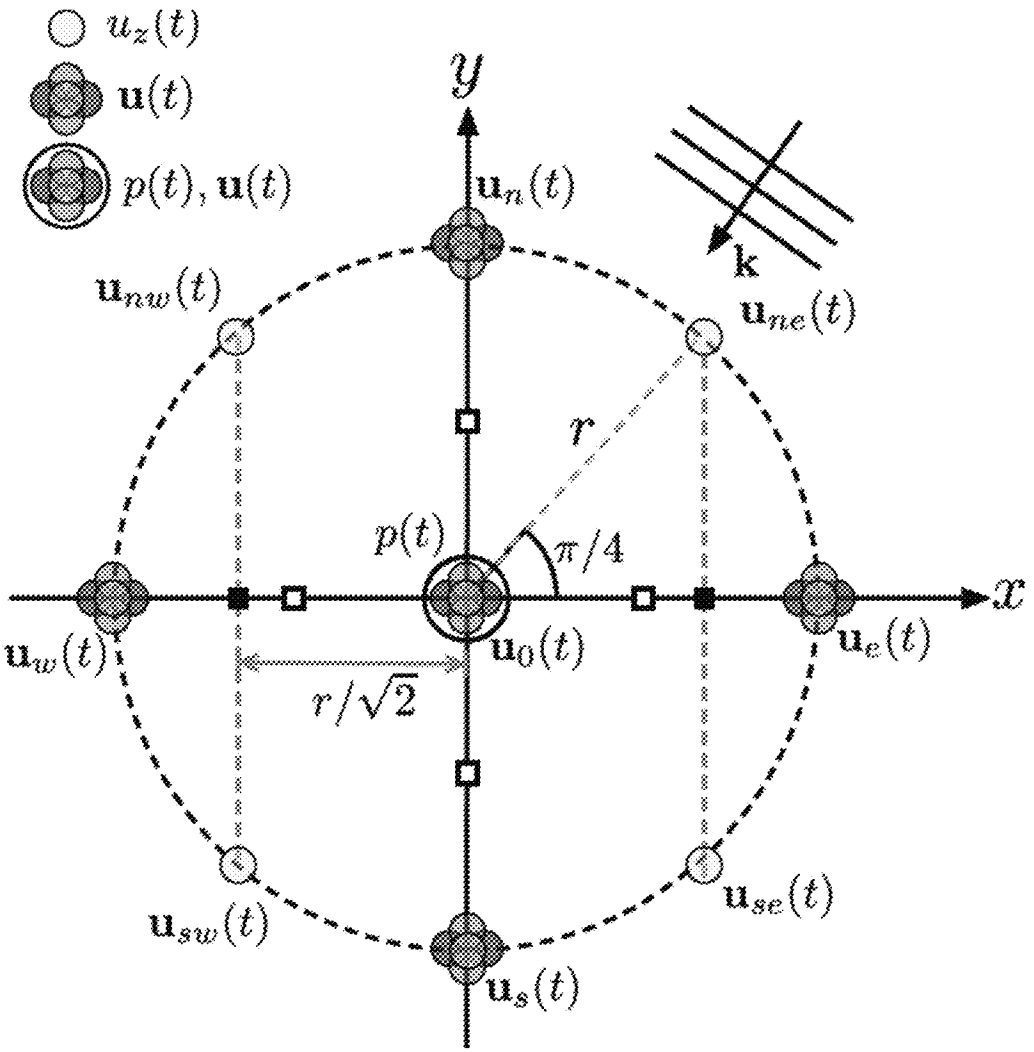
FIG. 2 Positions of acoustic vector sensors on the proposed microphone array.
Figure 3:
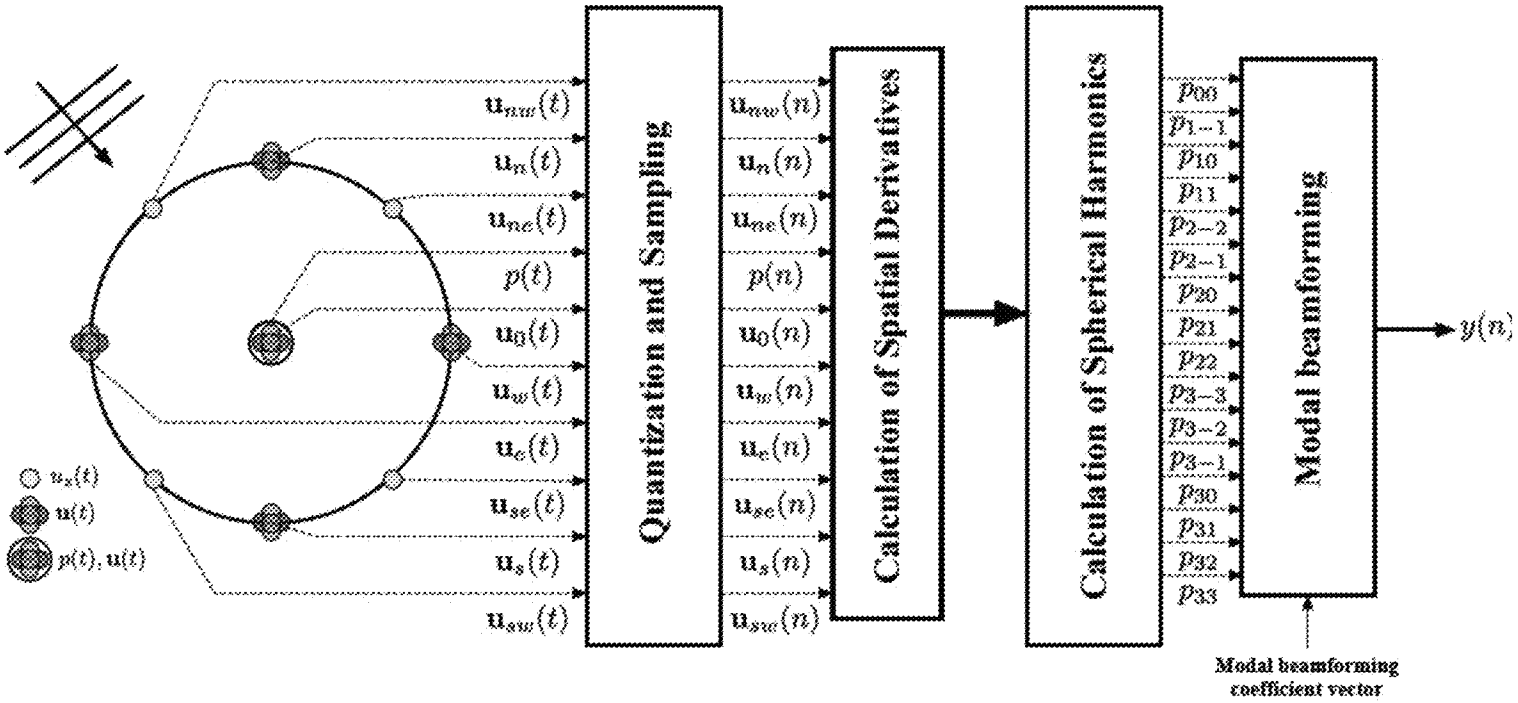
FIG. 3 The block diagram showing the stages of processing to obtain a steered beam.

The microphone array disclosed herein comprises five triaxial and four uniaxial acoustic particle velocity sensors and one pressure sensor. In the discussion that follows, we will assume that $x_0$ at which the spatial derivatives are calculated coincides with the problem origin, the array elements are coplanar in the horizontal plane and the reference axes are given and measurement points are labelled as in FIG. 2 which shows the preferred embodiment. This array allows a 3rd-degree spherical harmonic decomposition of a sound field. FIG. 3 shows the block diagram of the processing stages involved.

The quaternion valued time-domain signals are obtained from the sensors comprising the array after sampling and quantization steps as:

$$u(n)=\mathcal{T}s(n) \tag{26}$$

Here, the sensor signal vector is given as $s(n)=[p(n),u_{e,x}(n), \ldots ,u_{sw,z}(n)]^T$ and the 10×20 quaternion casting matrix is given as:

$$\mathcal{T} = \begin{bmatrix} 1 & 0 & 0 \\ 0 & I_{5\times 5}\otimes[i, j, k] & 0 \\ 0 & 0 & I_{4\times 4}\otimes k \end{bmatrix} \tag{27}$$

where $\otimes$ represents the Kronecker product. Notice that quaternion casting is not shown in FIG. 3 for purposes of clarity where the acquired signals are already assumed to be quaternion valued. Similarly, while the derivations presented in the following are in the frequency domain, a time-domain implementation is trivial to obtain.

Obtaining the elementwise quaternion Fourier transforms of u(n) results in the the array manifold vector given as:

$$\mathcal{U}(\omega)=[P_0,U_0,U_e,U_w,U_n,U_s,U_{ne},U_{se},U_{nw},U_{sw}]^T.$$

Note that the frequency dependence of individual terms are also omitted for clarity.

In order to express the output of the proposed array in a form similar to that of a conventional acoustic mode beamformer, let us define several quaternion and scalar valued vectors and matrices. The 7×1 spatial difference vector, $\mathcal{Q}(\omega)$ expressed as:

$$\mathcal{Q}(\omega)=W(\omega)D\,\mathcal{U}(\omega) \tag{28}$$

where the finite difference matrix is given as:

$$D = \begin{bmatrix} 1 & 0 & 0 & 0 & 0 & 0 & 0 & 0 & 0 & 0 \\ 0 & 1 & 0 & 0 & 0 & 0 & 0 & 0 & 0 & 0 \\ 0 & 0 & \frac{1}{2r} & \frac{-1}{2r} & 0 & 0 & 0 & 0 & 0 & 0 \\ 0 & 0 & 0 & 0 & \frac{1}{2r} & \frac{-1}{2r} & 0 & 0 & 0 & 0 \\ 0 & \frac{-2}{r^2} & \frac{1}{r^2} & \frac{1}{r^2} & 0 & 0 & 0 & 0 & 0 & 0 \\ 0 & \frac{-2}{r^2} & 0 & 0 & \frac{1}{r^2} & \frac{1}{r^2} & 0 & 0 & 0 & 0 \\ 0 & 0 & 0 & 0 & 0 & 0 & \frac{1}{2r^2} & \frac{-1}{2r^2} & \frac{-1}{2r^2} & \frac{1}{2r^2} \end{bmatrix},$$

and the integration matrix is expressed as:

$$W(\omega) = \mathrm{diag}\left\{1, 1, -\frac{c}{2v\omega}, -\frac{c}{2v\omega}, \frac{c^2}{4\omega^2}, \frac{c^2}{4\omega^2}, \frac{c^2}{4\omega^2}\right\}.$$

where v is an arbitrary transform axis. The spherical harmonic decomposition of the sound field can then be synthesized as:

$$P_{nm}(\omega)=S[\mathcal{G}\mathcal{B}\mathcal{Q}(\omega)] \tag{29}$$

where $\mathcal{B}$ is the eigenmode combination matrix given as:

$$\mathcal{B} = \begin{bmatrix} 1 & 0 & 0 & 0 & 0 & 0 & 0 \\ 0 & i-Ij & 0 & 0 & 0 & 0 & 0 \\ 0 & k & 0 & 0 & 0 & 0 & 0 \\ 0 & i+Ij & 0 & 0 & 0 & 0 & 0 \\ 0 & 0 & i-Ij & -(j+Ii) & 0 & 0 & 0 \\ 0 & 0 & k & -Ik & 0 & 0 & 0 \\ 2 & 0 & 3i & 3j & 0 & 0 & 0 \\ 0 & 0 & k & Ik & 0 & 0 & 0 \\ 0 & 0 & i+Ij & -(j-Ii) & 0 & 0 & 0 \\ 0 & 0 & 0 & 0 & i-3Ij & -3i-Ij & 0 \\ 0 & 0 & 0 & 0 & -k & k & -2Ik \\ 0 & 4(i-Ij) & 0 & 0 & -5(i+Ij) & -5(i+Ij) & 0 \\ 0 & 2k & 0 & 0 & -5k & -5k & 0 \\ 0 & 4(i+Ij) & 0 & 0 & -5(i-Ij) & -5(i-Ij) & 0 \\ 0 & 0 & 0 & 0 & -k & k & 2Ik \\ 0 & 0 & 0 & 0 & i+3Ij & -3i+Ij & 0 \end{bmatrix},$$

and $\mathcal{G}$ is the diagonal modal weight matrix that comprises modal weights used in equalizing the eigenmodes, such that:

$$\mathcal{G} = \mathrm{diag}\left\{[-\mathrm{sgn}(m)]^m\sqrt{\frac{2n+1}{4\pi}\frac{(n-|m|)!}{(n+|m|)!}}\right\}$$

where n=0, . . . , N and m=−n, . . . , n. Note that this selection of combination matrix is not unique and neither is it optimized for a specific purpose such as improving robustness of the proposed array to noise. Notice also that the elements of the eigenmode composition matrix are biquaternions (i.e. quaternions whose coefficients are complex).

Once the spherical harmonic decomposition coefficient vector is obtained, a beam with the desired characteristics can be formed by the appropriate selection of a beamforming vector, b such that:

$$Y(\omega)=S[b^T P_{nm}(\omega)] \tag{30}$$

For example, selecting the beamforming vector as:

$$b=[Y_0^0(\Omega_S)^* Y_1^{-1}(\Omega_S)^* \ldots Y_3^3(\Omega_S)^*]^T$$

would yield a maximum directivity factor (maxDF) beamform steered in the direction $\Omega_S=(\theta_s,\phi_s)$ [20]. Notice that not only the maxDF beam but also all other axisymmetric and non-axisymmetric directivity patterns up to N=3 can be obtained this way.

The present invention provides a microphone array comprising P pressure sensors, wherein P is greater than or equal to 1 and Q uniaxial, biaxial or triaxial acoustic particle velocity sensors, wherein Q is greater than or equal to 3, wherein one pressure sensor and one triaxial acoustic particle velocity sensor are positioned at the center of a circular arc and the remaining sensors arranged over the circular arc that subtends an angle φ, wherein φ is less than or equal to 2π; wherein individual signals registered by the sensors are substantially captured, sampled and quantized synchronously;

wherein approximations of all possible second-order and third-order partial spatial derivatives of the sound field at the center of the circular arc are calculated by elementary algebraic operations and frequency-dependent filtering of the signals captured by the individual sensors.

Also, coefficients of a spherical harmonic decomposition of a captured sound field are obtained by linearly combining the second-order and higher-order partial spatial derivatives, where a desired directional response is obtained by linearly combining the spherical harmonic decomposition coefficients.

In another embodiment of the invention, particle velocity signals are obtained by processing signals captured using two or more pressure sensors or the particle velocity signals are obtained by processing signals captured using two or more directional microphones The present invention also provides a microphone array wherein coefficients of a spherical harmonic decomposition of a captured sound field are obtained by linearly combining the second-order and higher-order partial spatial derivatives and desired directional response is obtained by linearly combining the spherical harmonic decomposition coefficients comprising five triaxial and four uniaxial acoustic particle velocity sensors and one pressure sensor arranged on a circle, wherein one pressure sensor and one triaxial acoustic particle velocity sensor are positioned at the center of the circle, in alignment with the local principal axes of the circle and the remaining sensors are arranged in such a way that each of the sensors on the circle is separated by $\phi=\pi/4$ from the others, wherein four of the triaxial particle velocity sensors whose local axes are aligned with the principal axes of the circle are positioned at $\phi_1=0$, $\phi_2=\pi/2$, $\phi_3=3\pi/2$, and $\phi$6hd 4$_4=\pi$ with respect to the local x-axis of the microphone array;

wherein four uniaxial particle velocity sensors that are aligned with the z-axis of the microphone array are positioned at $\phi_5=\pi/4$, $\phi_6=3\pi/4$, $\phi_7=5\pi/4$, and $\phi_8=7\pi/4$ with respect to the local x-axis of the microphone array, wherein the sampled and quantized signals obtained from each of the sensors are expressed as quaternion valued signals;

wherein spatial derivatives of the captured sound field are calculated by linear combinations of two or more of the said quaternion valued signals resulting in quaternion valued spatial derivative signals;

wherein spherical harmonic coefficients are obtained as a weighted sum of the said quaternion valued spatial derivative signals;

wherein a spherically steerable directivity pattern is obtained by a weighted sum of the spherical harmonic coefficients.

V. NUMERICAL EXAMPLES

We provide two sets of numerical examples. We will first demonstrate the synthesis of spherical harmonic functions using signals from the proposed array. We will then show the synthesis of maximum directivity factor beam using the approach described above.

Figure 4:
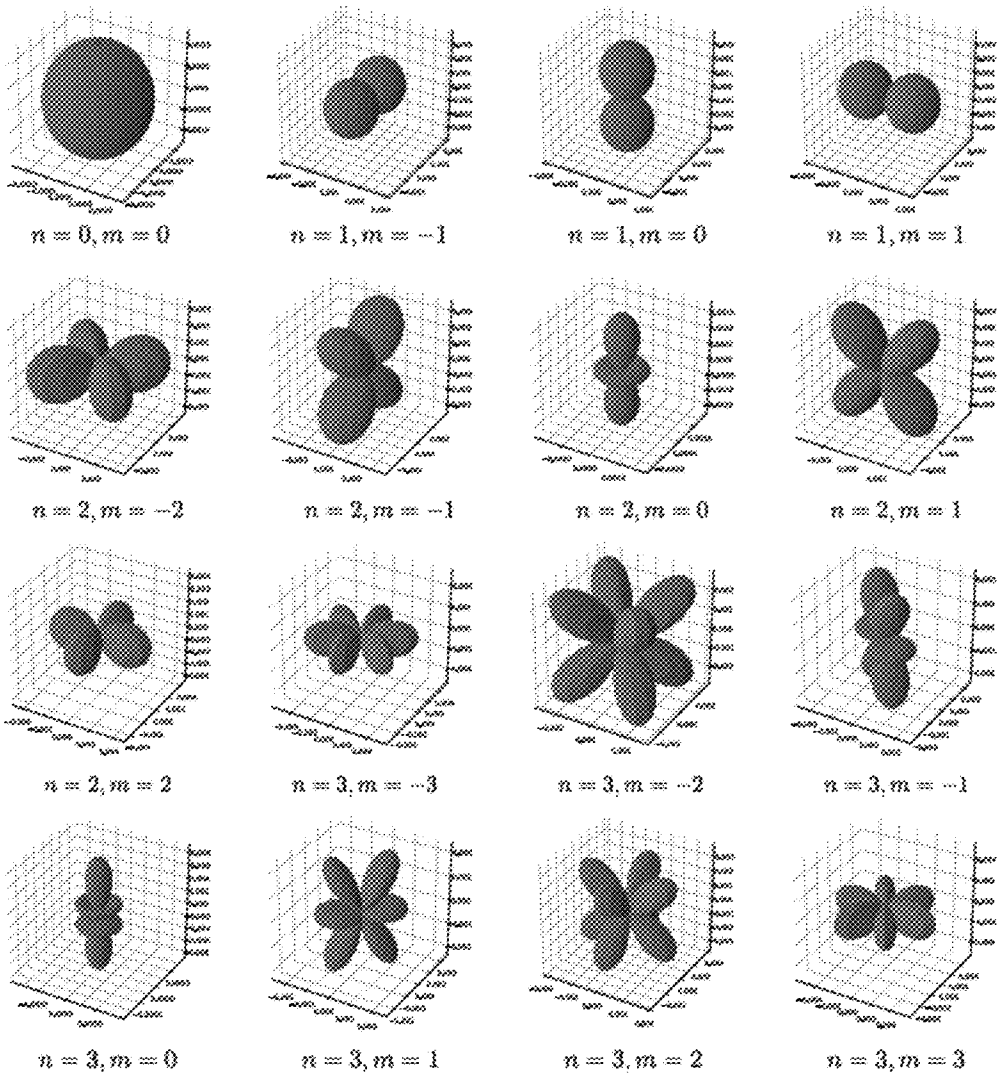
FIG. 4 The spherical harmonic components up to n=3 obtained using the proposed VDMA structure with a monochromatic plane wave having a frequency of f=1 kHz.
Figure 5A:
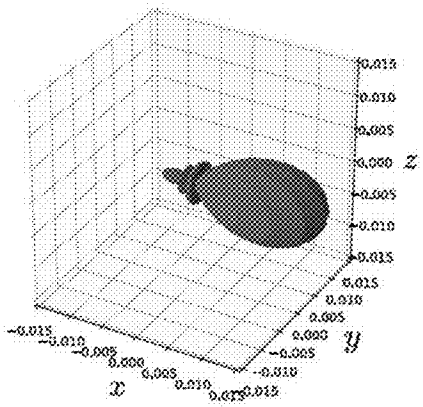
FIG. 5A Maximum directivity beam obtained using VDMA steered in different directions, $(\theta,\phi)$ for a monochromatic plane wave field with f=1 kHz, wherein $(\theta,\phi)$ is $(\pi/2,0)$.
Figure 5B:
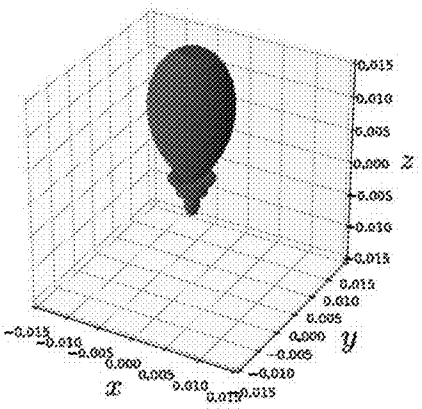
FIG. 5B Maximum directivity beam obtained using VDMA steered in different directions, $(\theta,\phi)$ for a monochromatic plane wave field with f=1 kHz, wherein $(\theta,\phi)$ is (0,0).
Figure 5C:
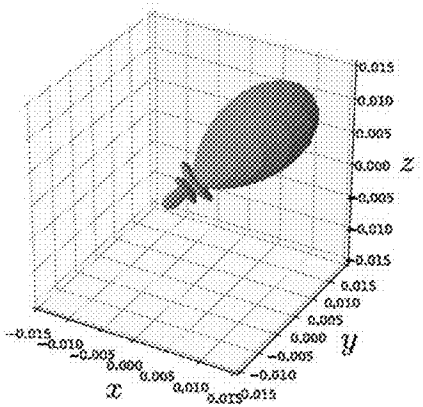
FIG. 5C Maximum directivity beam obtained using VDMA steered in different directions, $(\theta,\phi)$ for a monochromatic plane wave field with f=1 kHz, wherein $(\theta,\phi)$ is $(0.25\pi,0.3\pi)$.
Figure 5D:
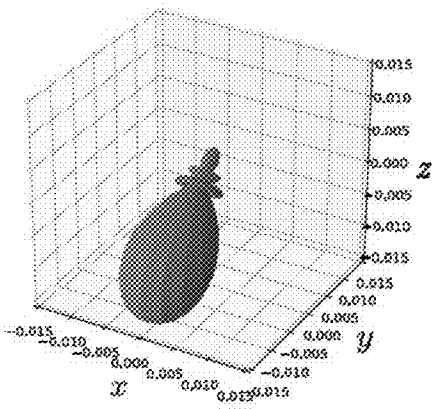
FIG. 5D Maximum directivity beam obtained using VDMA steered in different directions, $(\theta,\phi)$ for a monochromatic plane wave field with f=1 kHz, wherein $(\theta,\phi)$ is $(3\pi/4,-\pi/2)$.
Figure 6A:
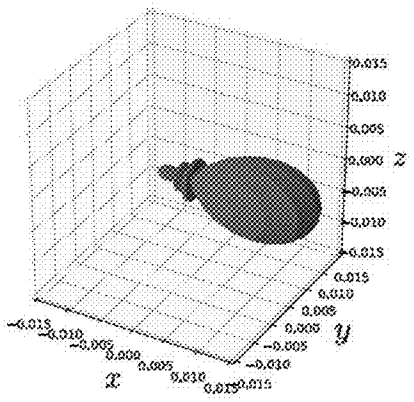
FIG. 6A Maximum directivity beam obtained using VDMA steered in the +x direction for different values of kr for a monochromatic plane wave field, wherein kr=0.125.
Figure 6B:
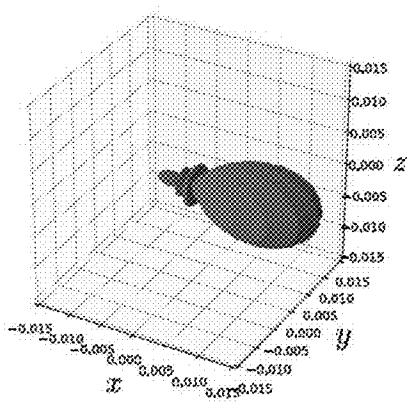
FIG. 6B Maximum directivity beam obtained using VDMA steered in the +x direction for different values of kr for a monochromatic plane wave field, wherein kr=0.25.
Figure 6C:
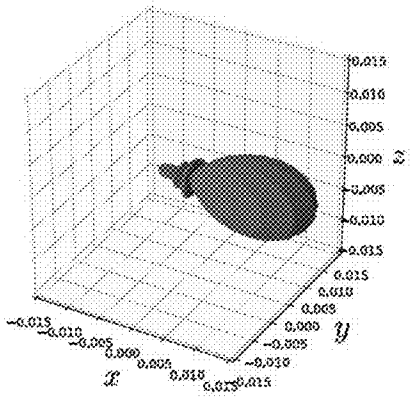
FIG. 6C Maximum directivity beam obtained using VDMA steered in the +x direction for different values of kr for a monochromatic plane wave field, wherein kr=0.5.
Figure 6D:
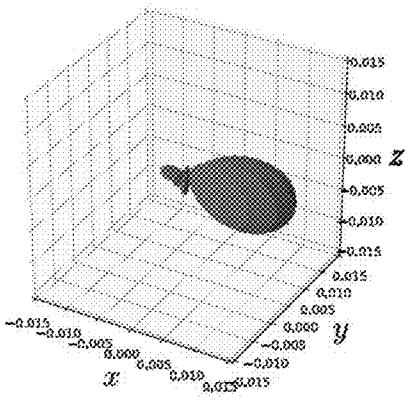
FIG. 6D Maximum directivity beam obtained using VDMA steered in the +x direction for different values of kr for a monochromatic plane wave field, wherein kr=1.

A. Spherical Harmonic Components The proposed array structure allows the synthesis of spherical harmonic components up to third order. FIG. 4 shows the spherical harmonics that can be obtained using the proposed VDMA for an array radius of r=2 cm and for a monochromatic sound field with f=1 kHz. The array coordinates are aligned with the problem coordinates. Notice the scale difference between different directivity plots that is due to normalization of different components differently.

B. Maximum Directivity Factor Beamforming

Maximum directivity factor (MaxDF) beam provides the narrowest possible beam width for a given order and is used widely with spherical microphone arrays in DOA estimation methods such as steered response power (SRP) [21], hierarchical grid refinement (HiGRID) [14], and residual energy test (RENT) [22]. VDMAs, by virtue of the fact that they can provide the spherical harmonic decomposition of the sound field, can be used to obtain a frequency and rotation invariant maxDF beam that can be spherically steered. FIGS. 5A-5D show a third order maxDF beam steered in four different directions. Notice that the beam shape is invariant of the steering direction.

An important side effect of using a finite difference approximation is frequency dependence. More specifically, the small angle approximation given in Eqn. (13) ceases to hold when the wavelength is smaller than the array radius. This limits the useful range of frequencies and/or orders that VDMA can be used for. This effect is shown in FIGS. 6A-6D for different values of kr with r=2 cm for a maxDF beam steered in the +x direction. It may be observed that the beam shape starts to deteriorate for kr≥1. However, the beam shape is substantially the same for lower values of kr.

REFERENCES

[1] Craven, P. G., & Gerzon, M. A. (1977). U.S. Pat. No. 4,042,779. Washington, DC: U.S. Patent and Trademark Office.

[2] Rafaely, B., 2011. Bessel nulls recovery in spherical microphone arrays for time-limited signals. *IEEE transactions on audio, speech, and language processing,* 19(8), pp.2430-2438.

[3] Yu, G., Xie, B. S., & Liu, Y. (2012, October). Analysis on multiple scattering between the rigid-spherical microphone array and nearby surface in sound field recording. In *Audio Engineering Society Convention* 133. Audio Engineering Society.

[4] Elko, G. W. (2004). Differential microphone arrays. In *Audio signal processing for next-generation multimedia communication systems* (pp. 11-65). Springer, Boston, Mass.

[5] De Sena, E., Hacihabiboglu, H., & Cvetkovic, Z. (2011). On the design and implementation of higher order differential microphones. *IEEE Transactions on Audio, Speech, and Language Processing,* 20(1), 162-174.

[6] Song, H., & Liu, J. (2008, July). First-order differential microphone array for robust speech enhancement. In 2008 *International Conference on Audio, Language and Image Processing* (pp. 1461-1466). IEEE.

[7] De Sena, E., Hacihabiboğlu, H., & Cvetković, Z. (2013). Analysis and design of multichannel systems for perceptual sound field reconstruction. *IEEE transactions on audio, speech, and language processing,* 21(8), 1653-1665.

[8] Benesty, J., Chen, J., & Cohen, I. (2015). *Design of Circular Differential Microphone Arrays* (Vol. 12). Switzerland: Springer.

[9] Huang, G., Chen, J., & Benesty, J. (2019). Design of planar differential microphone arrays with fractional orders. *IEEE/ACM Transactions on Audio, Speech, and Language Processing,* 28, 116-130.

[10] Meyer, J., & Elko, G. (2002, May). A highly scalable spherical microphone array based on an orthonormal decomposition of the soundfield. In 2002 *IEEE International Conference on Acoustics, Speech, and Signal Processing* (Vol. 2, pp. II-1781). IEEE.

[11] Rafaely, B. (2015). *Fundamentals of spherical array processing* (Vol. 8, pp. 45-47). Berlin: Springer.

[12] Moreau, S., Daniel, J., & Bertet, S. (2006, May). 3D sound field recording with higher order ambisonics—Objective measurements and validation of a 4th order spherical microphone. In 120*th Convention of the AES* (pp. 20-23).

[13] Erdem, E., De Sena, E., Hacihabiboğlu, H., & Cvetković, Z. (2019, May). Perceptual Soundfield Reconstruction in Three Dimensions via Sound Field Extrapolation. In *ICASSP* 2019-2019 *IEEE International Conference on Acoustics, Speech and Signal Processing* (*ICASSP*) (pp. 8023-8027). IEEE.

[14] Çöteli, M. B., Olgun, 0., & Hacihabiboğlu, H. (2018). Multiple sound source localization with steered response power density and hierarchical grid refinement. *IEEE/ACM Transactions on Audio, Speech, and Language Processing,* 26(11), 2215-2229.

[15] Tervo, S., & Politis, A. (2015). Direction of arrival estimation of reflections from room impulse responses using a spherical microphone array. *IEEE/ACM Transactions on Audio, Speech, and Language Processing,* 23(10), 1539-1551.

[16] Fahim, A., Samarasinghe, P. N., & Abhayapala, T. D. (2018). PSD estimation and source separation in a noisy reverberant environment using a spherical microphone array. *IEEE/ACM Transactions on Audio, Speech, and Language Processing,* 26(9), 1594-1607.

[17] Çöteli, M. B., & Hacihabiboğlu, H. (2018, September). Acoustic Source Separation Using Rigid Spherical Microphone Arrays Via Spatially Weighted Orthogonal Matching Pursuit. In 2018 16*th International Workshop on Acoustic Signal Enhancement* (*IWAENC*) (pp. 81-85). IEEE.

[18] Jacobsen, F., & De Bree, H. E. (2008). The microflown particle velocity sensor. In *Handbook of Signal Processing in Acoustics* (pp. 1283-1291). Springer, New York, N.Y.

[19] Ell, T. A., Le Bihan, N., & Sangwine, S. J. (2014). *Quaternion Fourier transforms for signal and image processing.* John Wiley & Sons.

[20] Sun, H., Yan, S., & Svensson, U. P. (2010, March). Space domain optimal beamforming for spherical microphone arrays. In 2010 *IEEE International Conference on Acoustics, Speech and Signal Processing* (pp. 117-120). IEEE.

[21] Jarrett, D. P., Habets, E. A., & Naylor, P. A. (2017). *Theory and applications of spherical microphone array processing* (Vol. 9). New York: Springer.

[22] Çöteli, M. B., & Hacihabiboğlu, H. (2019, May). Multiple Sound Source Localization with Rigid Spherical Microphone Arrays via Residual Energy Test. In *ICASSP* 2019-2019 *IEEE International Conference on Acoustics, Speech and Signal Processing* (*ICASSP*) (pp. 790-794). IEEE.

What is claimed is:

1. A microphone array comprising:

P pressure sensors, wherein P is greater than or equal to 1, and

Q uniaxial, biaxial or triaxial acoustic particle velocity sensors, wherein Q is greater than or equal to 3, wherein one pressure sensor and one triaxial acoustic particle velocity sensor are positioned at a center of a circular arc and remaining sensors arranged over the circular arc subtending an angle $\varphi$, wherein $\varphi$ is less than or equal to $2\pi$;

wherein individual signals registered by the Q uniaxial, biaxial or triaxial acoustic particle velocity sensors are substantially captured, sampled, and quantized synchronously;

wherein approximations of all possible second-order partial spatial derivatives and third-order partial spatial derivatives of a sound field at the center of the circular arc are calculated by elementary algebraic operations and a frequency-dependent filtering of the individual signals captured by individual sensors.

2. The microphone array according to claim 1, wherein coefficients of a spherical harmonic decomposition of a captured sound field are obtained by linearly combining the second-order partial spatial derivatives and higher-order partial spatial derivatives.

3. The microphone array according to claim 2, wherein a desired directional response is obtained by linearly combining the coefficients of the spherical harmonic decomposition.

4. The microphone array according to claim 1, wherein acoustic particle velocity signals are obtained by processing signals captured using two or more pressure sensors.

5. The microphone array according to claim 1, wherein acoustic particle velocity signals are obtained by processing signals captured using two or more directional microphones.

6. The microphone array according to claim 3, comprising five triaxial acoustic particle velocity sensors and four uniaxial acoustic particle velocity sensors and the one pressure sensor arranged on a circle, wherein the one pressure sensor and the one triaxial acoustic particle velocity sensor are positioned at a center of the circle, in alignment with local principal axes of the circle and the remaining sensors are arranged in such a way that each of the remaining sensors on the circle is separated by $\phi=\pi/4$ from each other, wherein four of the five triaxial acoustic particle velocity sensors are positioned at $\phi_1=0$, $\phi_2=\pi/2$, $\phi_3=3\pi/2$, and $\phi_4=\pi$ with respect to a local x-axis of the microphone array, wherein local axes of the four of the five triaxial acoustic particle velocity sensors are aligned with the local principal axes of the circle;

wherein the four uniaxial acoustic particle velocity sensors aligned with a z-axis of the microphone array are positioned at $\phi_5=\pi/4$, $\phi_6=3\pi/4$, $\phi_7=5\pi/4$, and $\phi_8=7\pi/4$ with respect to the local x-axis of the microphone array, wherein sampled and quantized signals obtained from the each of the remaining sensors are expressed as quaternion valued signals;

wherein spatial derivatives of the captured sound field are calculated by linear combinations of two or more of the quaternion valued signals resulting in quaternion valued spatial derivative signals;

wherein spherical harmonic coefficients are obtained as a weighted sum of the quaternion valued spatial derivative signals;

wherein a spherically steerable directivity pattern is obtained by a weighted sum of the spherical harmonic coefficients.

* * * * *